US008720437B2

(12) United States Patent
Aubonnet et al.

(10) Patent No.: US 8,720,437 B2
(45) Date of Patent: May 13, 2014

(54) PROTECTIVE HEADGEAR EQUIPMENT WITH RESPIRATOR AND OPTICAL SHIELD

(75) Inventors: Severine Aubonnet, Fontenay-les-Fleury (FR); Frederic Berthet, Saulx-Marchais (FR)

(73) Assignee: Intertechnique, Plaisir Cedex (FR)

( * ) Notice: Subject to any disclaimer, the term of this patent is extended or adjusted under 35 U.S.C. 154(b) by 1030 days.

(21) Appl. No.: 12/523,160

(22) PCT Filed: Jan. 19, 2007

(86) PCT No.: PCT/IB2007/000581

§ 371 (c)(1),
(2), (4) Date: Aug. 13, 2009

(87) PCT Pub. No.: WO2008/087468

PCT Pub. Date: Jul. 24, 2008

(65) Prior Publication Data

US 2010/0065061 A1 Mar. 18, 2010

(51) Int. Cl.

| | |
|---|---|
| ***A62B 9/04*** | (2006.01) |
| ***A62B 18/08*** | (2006.01) |
| ***A62B 17/04*** | (2006.01) |
| ***A62B 18/00*** | (2006.01) |

(52) U.S. Cl.
USPC ..... 128/202.27; 128/206.23; 128/201.23

(58) Field of Classification Search
USPC ..... 128/206.23, 206.21, 206.27, 206.28, 128/202.27, 200.27, 201.12, 201.14, 128/201.24, 201.22, 201.23, 201.27, 128/201.28, 206.24, 201.15, 201.17, 128/201.25, 206.12, 206.13, 206.15, 128/206.17; 2/6.2, 6.3, 8.6, 424, 427, 428, 2/429, 430, 9, 173; 403/252–254, 240, 403/326, 329
See application file for complete search history.

(56) References Cited

U.S. PATENT DOCUMENTS

| | | | | |
|---|---|---|---|---|
| 5,630,412 | A | 5/1997 | Dubruille et al. | |
| 5,720,281 | A * | 2/1998 | Allen et al. | 128/206.23 |
| 6,401,716 | B1 | 6/2002 | Sword et al. | |
| 7,549,420 | B2 * | 6/2009 | Martinez et al. | 128/201.22 |
| 2005/0210556 | A1 * | 9/2005 | Martinez et al. | 2/9 |
| 2006/0196503 | A1 | 9/2006 | Bardel | |

FOREIGN PATENT DOCUMENTS

| | | |
|---|---|---|
| EP | 0288391 | 10/1988 |
| FR | 2853554 | 10/2004 |

* cited by examiner

*Primary Examiner* — Lynne Anderson
*Assistant Examiner* — Bradley Philips
(74) *Attorney, Agent, or Firm* — Kilpatrick Townsend & Stockton LLP; Dean W. Russell, Esq.; Kristin M. Crall, Esq.

(57) ABSTRACT

A head protective equipment comprises: —a breathing mask (2) connectable to a breathing-gas source and adapted to be applied, in a use position, around an user's nose and mouth, for supplying said user with breathing gas; —a shield (6) adapted to be applied around the user's eyes; and—first and second lock elements (28, 30, 38, 40), respectively located on said mask and on said shield, and adapted to cooperate with each other in order to secure said shield to said mask when said mask is in said use position around said user's nose and mouth, said first and second elements being adapted to create a snap-together connection, —said shield and said mask being adapted to be locked together by a two-step movement, the first step consisting in approaching the shield to the mask until said shield reaches said mask, and the second step being a substantially linear movement until locking.

17 Claims, 4 Drawing Sheets

PROTECTIVE HEADGEAR EQUIPMENT WITH RESPIRATOR AND OPTICAL SHIELD

CROSS REFERENCE TO RELATED APPLICATIONS

This application is the U.S. national phase of International Application No. PCT/IB2007/000581 filed on Jan. 19, 2007 and published in English on Jul. 24, 2008 as International Publication No. WO 2008/087468 A1, the entire contents of which are incorporated herein in their entirety by reference.

The invention relates to a protective equipment for the head, with a breathing mask and an optical shield.

More particularly, the invention relates to protective equipment for the head comprising:

- a breathing mask that can be connected to a breathing-gas source and adapted to be applied, in a position of use, around the nose and the mouth of a user, and for supplying him/her with breathing gas,
- a eye protective shield adapted to be applied around his/her eyes, and
- first and second lock elements, respectively located on the mask and on the shield and adapted to cooperate with each other in order to secure the shield to the mask when the mask is in its position of use on the user's face.

The invention has a particularly important, though not exclusive, application in aeronautics. The mask then makes it possible to combat hypoxia or the inhalation of toxic gases. Regulations may also demand that pilots and co-pilots of transport aircraft wear equipment for protection against hypoxia permanently in certain flight conditions, and particularly at very high altitude or when a single pilot is present in the cockpit.

During this period, the mask is worn without a shield. However in case of fire or in presence of smoke or irritating gases, the wearer needs to add easily and quickly a shield to protect his eyes while he keeps the mask on his face.

Document U.S. Patent Application No. 2005/0210556 discloses an example of such protective equipment that is entirely satisfactory in term of protection. However, it could be advantageous to have such equipment in which the positioning of the shield on the mask as well as the unlocking of the shield from the mask, in particular when the mask is already in place on the user's face, is carried out even more simply and more naturally.

To better address one or more concerns, in a first aspect of the invention, a head protective equipment comprises:

- a breathing mask connectable to a breathing-gas source and adapted to be applied, in a use position, around the user's nose and mouth, for supplying the user with breathing gas;
- a eye protective shield adapted to be applied around the user's eyes; and
- first and second lock elements, respectively located on the mask and on the shield, and adapted to cooperate with each other in order to secure the shield to the mask when the mask is in the use position on the user's face. The first and second elements are adapted to engage and interlock with each other to create a snap-together connection.

The shield and the mask are adapted to be locked together by a two-step movement, the first step consisting in approaching the shield to the mask until the shield reaches the mask, and the second step being a substantially linear movement of bringing the shield closer to the user's nose until locking.

The head protective equipment has the advantage to put in place the shield by a natural movement of the user.

In a particular embodiment, the shield comprises a grasping unit around the second lock element. The grasping unit comprises two substantially vertical surfaces and one substantially horizontal surface, the surfaces being adapted to receive the user's fingers during the positioning of the shield onto the mask. Particularly, the vertical surfaces are adapted to receive the user's thumb and middle finger and the horizontal surface is adapted to receive the user's forefinger. The embodiment has the advantage to offer a natural position of the user's fingers to grasp the shield.

In another embodiment, the mask has guidance elements to guide the shield to the locking position during the substantially linear movement. The guidance elements comprise a support area adapted to receive the shield at the end of the first step movement. They comprises also guidance surfaces diverging from a ridge situated substantially in coincidence with the user's nose bridge, and forming two wings that are substantially symmetrical with respect to a median plane of symmetry of the user's face when the equipment is being worn by the user. The wings are substantially parallel to the linear movement. This embodiment has the advantage to guide the user in the positioning of the shield onto the mask.

An other aspect of the invention is a method to lock a eye protective shield onto a breathing mask. The breathing mask is connectable to a breathing-gas source and adapted to be applied, in a use position, around an user's nose and mouth, for supplying the user with breathing gas. The eye protective shield is adapted to be applied around the user's eyes. The mask and the shield are lockable by first and second lock elements, respectively located on the mask and on the shield, and adapted to cooperate with each other in order to secure the shield to the mask when the mask is in the use position around the user's nose and mouth. The first and second elements are adapted to engage and interlock with each other to create a snap-together connection. The method comprises:

- approaching the shield to the mask until the shield reaches the mask,
- moving in a substantially linear movement the shield onto the mask to bring the shield closer to the user's nose until locking.

These and other aspects of the invention will be apparent from and elucidated with reference to the embodiment described hereafter where:

In the following description, like reference numerals will be used to refer to like or corresponding elements in the different figures of the drawings. Position terms such as "top", "bottom", etc. are used to define relative position of elements of a protective equipment when it is worn by a user.

Figure 1:
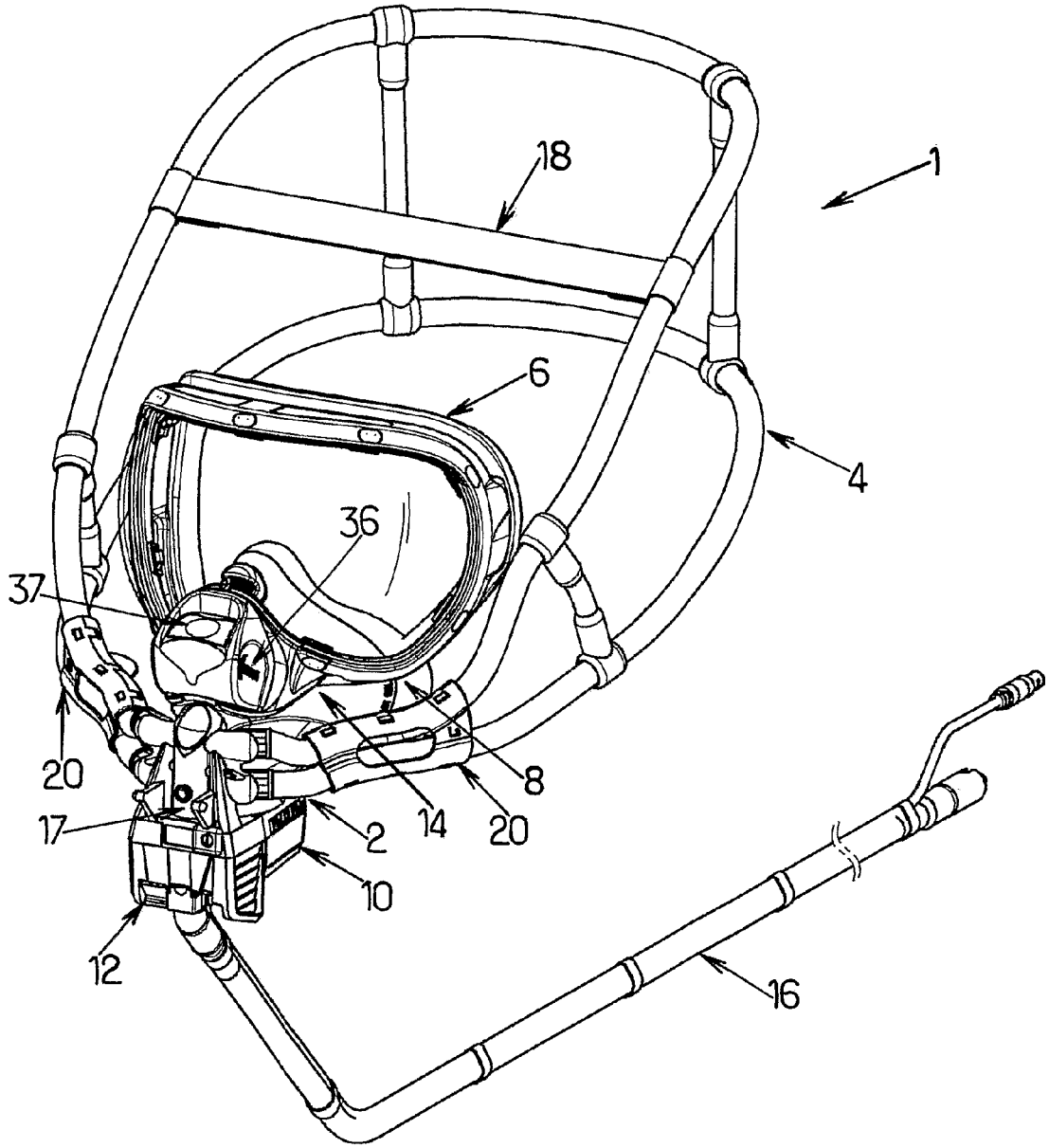
FIG. 1 is an isometric view of a protective head equipment in accordance with an embodiment of the invention.

Referring to FIG. 1, protective equipment 1 comprises a mask 2, a harness 4 and a shield 6.

The mask 2 and the harness 4 are of a known type. They are for example of the type of those already described by the documents EP-A-0288391 or U.S. Pat. No. 5,630,412.

The mask 2 comprises a mouth-and-nose face cover 8, a demand regulator 10, a connecting unit 12 and a shell 14. The demand regulator 10 is connected to a source of pressurized breathing gas by a flexible tube 16. The connecting unit 12 connects the demand regulator 10 to the inflatable harness 4 through a harness block 17. The shell 14 covers the front of the mouth-and-nose face cover 8.

The harness is fitted with straps 18 to maintain the mask 2 in use position on user's head. On each side of the mask 2, a positioning member 20 positions the harness outside the area of the user's face covered by the shield 6 in use position. In another aspect, positioning members 20 are adapted to guide the harness around the head of the user even when the harness is not inflated. Therefore, the user can put in place the mask around his/her nose and mouth by using a single hand.

Figure 2:
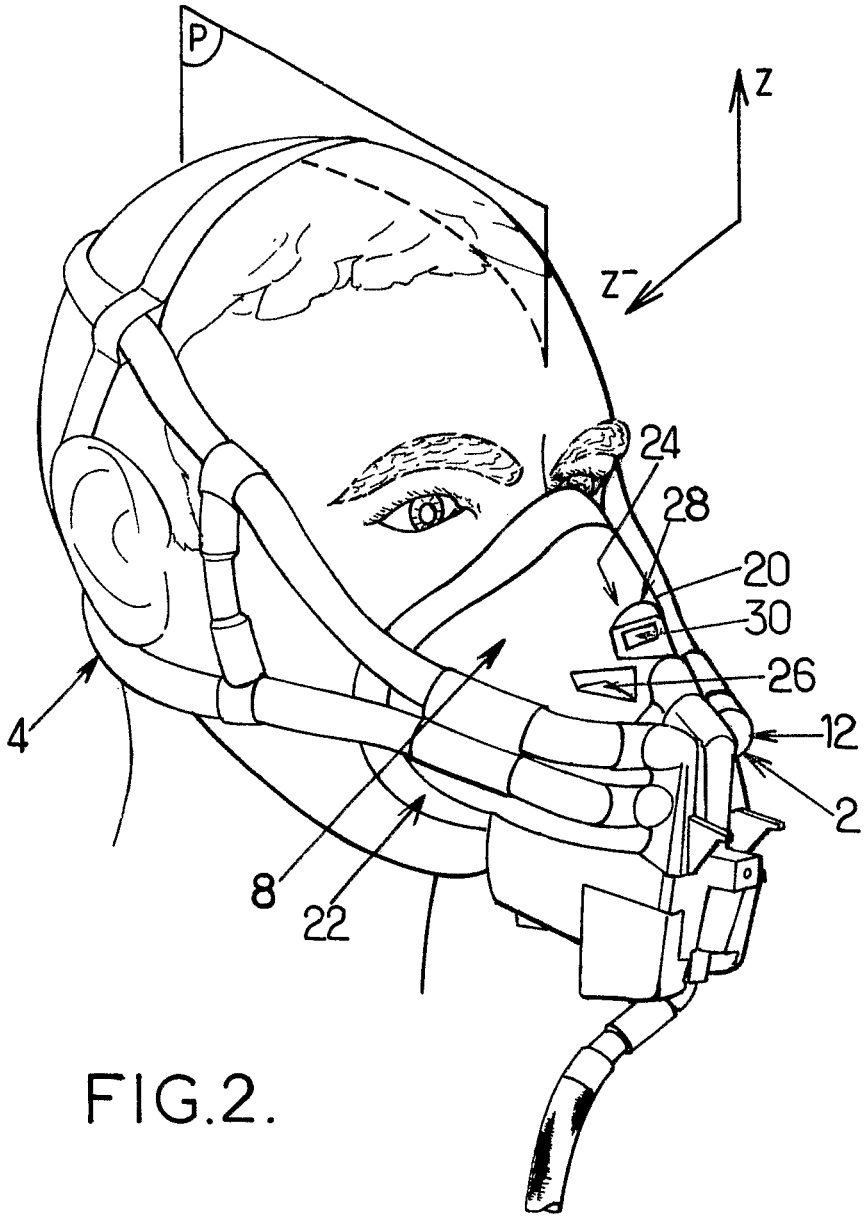
FIG. 2 is an isometric view of a mask of the protective head equipment of FIG. 1.
Figure 3:
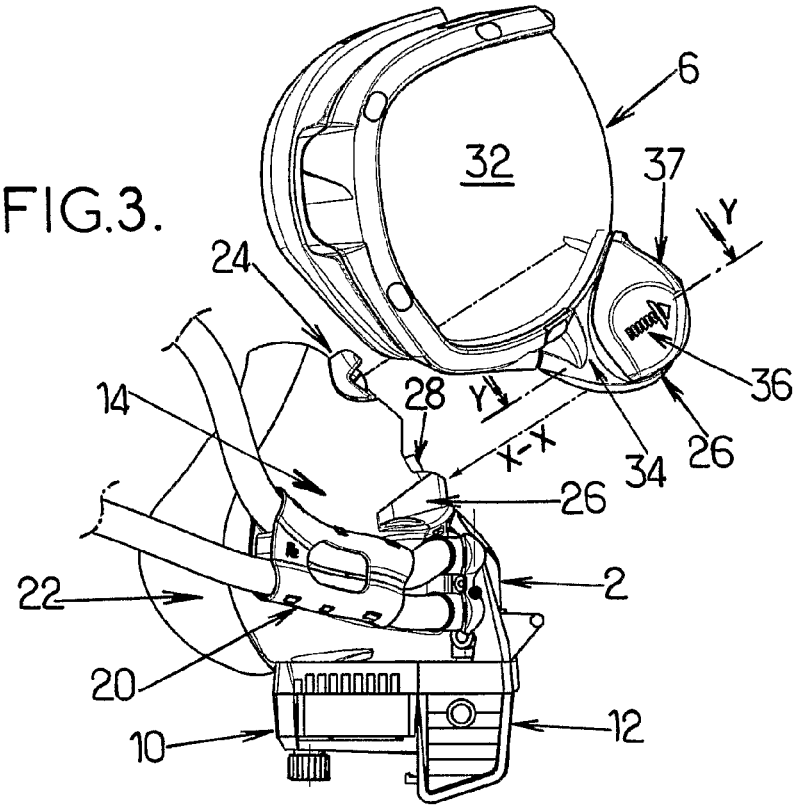
FIG. 3 is a lateral view of the mask and shield of the protective head equipment of FIG. 1.

As shown in FIG. 2 and FIG. 3, the mouth-and-nose face cover 8 is adapted to be applied over the bottom of a user's face. The mouth-and-nose face cover 8 comprises a cavity covering the nose and the mouth of the user. This cavity is lined with a flexible membrane also extending all around the latter in order to form a seal 22 intended to be applied in contact with the user's face.

The shell 14 comprises a ridge surface 24 located substantially in coincidence with that of the user's nose when the user is wearing the mask 2. The shell 14 is substantially symmetric with respect to a median plane P corresponding to the plane of symmetry of the user's head. It comprises, on each side of the median plane P, two guidance surfaces 26, forming a groove having a funnel form starting from the ridge surface 24. The two grooves define a translation axe XX substantially perpendicular to the ridge surface 24.

On the ridge surface 24, above the start of the guidance surfaces 26, a substantially plane surface 28 is perpendicular to the translation axe XX. The plane surface 28 comprises an opening 30 having a rectangular shape. The opening 30 is horizontally-oriented.

The shield 6 comprises a protection glass 32 and, beneath the protection glass 32, a grasping unit 34.

The grasping unit 34 comprises two substantially vertical grasping surfaces 36 and a substantially horizontal grasping unit 37. The grasping surfaces 36 have an ergonomic shape adapted to receive the user's fingers and particularly the user's thumb and middle finger for the vertical surfaces 36 and the forefinger for the horizontal surface 37.

Figure 4:
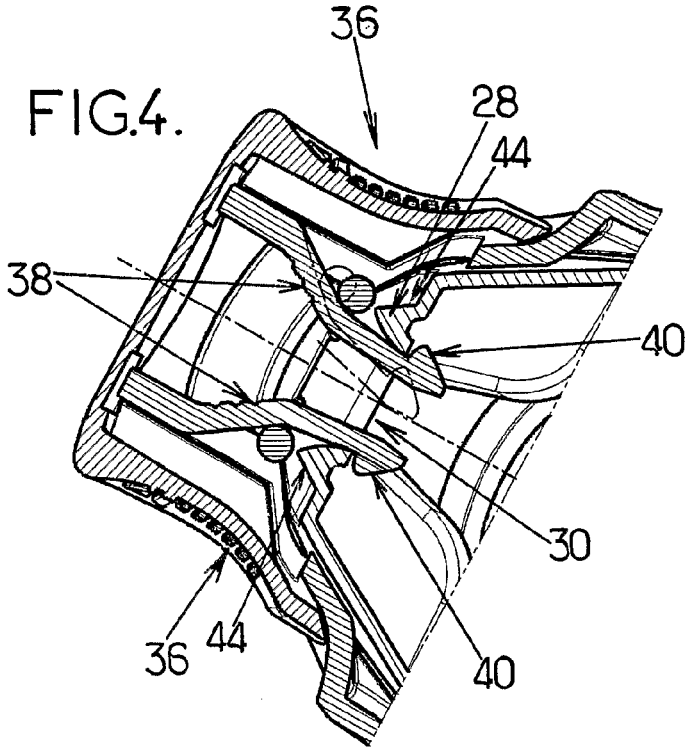
FIG. 4 is a sectional view along a Y-Y axis of the protective head equipment of FIG. 1.
Figure 5:
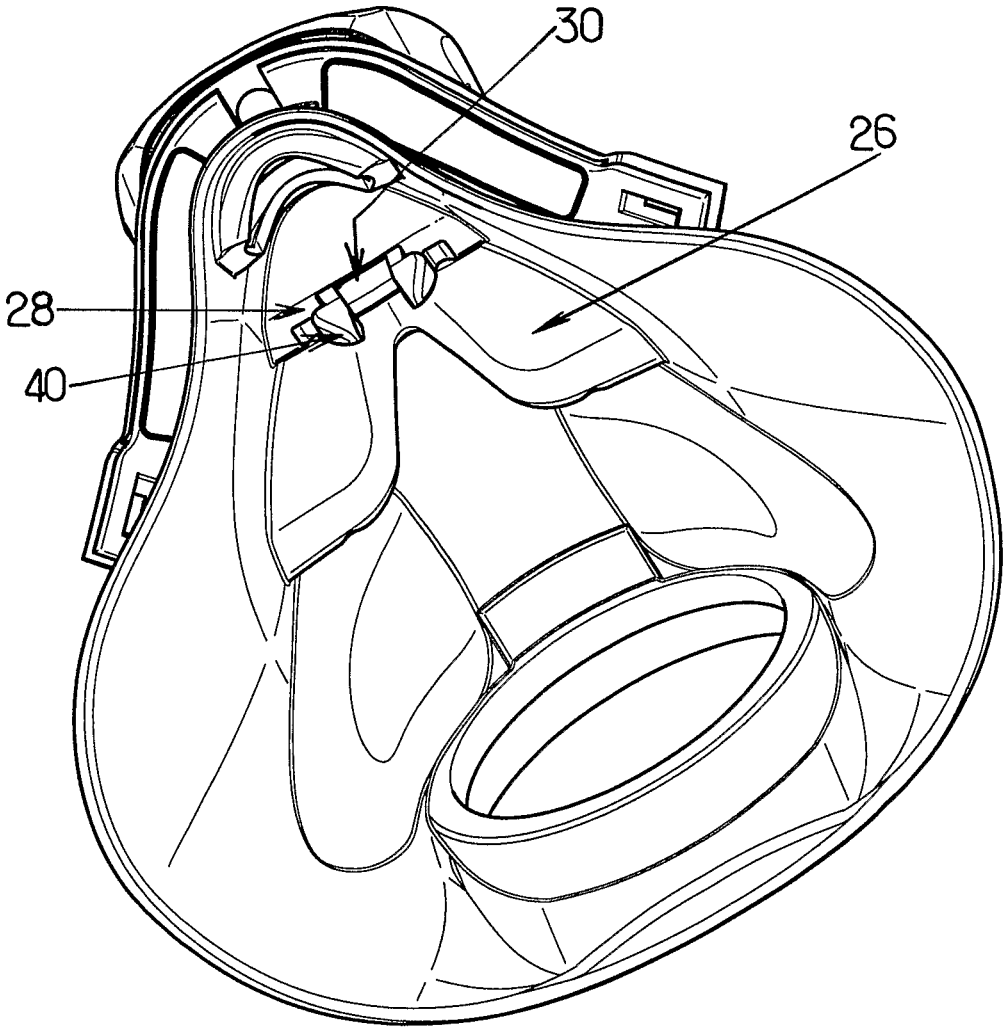
FIG. 5 is a isometric view from the rear of the mask of the protective head equipment of FIG. 1.

Inside the grasping unit 34, FIG. 4 and FIG. 5, between the two grasping surfaces 36, two flexible pins 38 are attached by their proximal ends to the grasping unit 34 and form at their distal ends a hook 40 turned outwards. Each hook 40 has a substantially triangular shape.

The two pins 38 form a substantially horizontal plane.

Under the two pins 38, two convex parts 44 have a form adapted to be placed between the guidance surfaces 26 of the mask.

The operation of the head protective equipment is the following.

The user has already the mask 2 in place on his mouth and nose. The mask is kept on the user's face by the harness 4.

The user takes the shield 6 by pinching the grasping unit between the user's thumb and middle finger onto the vertical grasping surfaces 36. The forefinger is placed onto the horizontal grasping surface 37. The finger position is natural and helps to position correctly the shield in space.

In a first movement, similar to the natural movement consisting to touch the nose with the finger, the user approaches the shield to the mask until the shield reaches the mask.

The harness block 17, the positioning members 20 as well as the part of the harness between the harness block and the positioning members act as a support element which receives the shield at the end of this first movement.

Then, in a linear movement guided by the support element along the axis XX, the user brings the shield 6 closer to the mask 2 until the convex parts 44 arrive at the level of the guidance surfaces 26. Then, the movement is guided by the guidance surfaces 26 in which the convex parts 44 are inserted. As the guidance surfaces have a funnel-type form, the movement is increasingly guided and precise in the positioning of the shield vis-à-vis the mask. With the guided movement, the distal ends of the pins 38 arrive at the level of the opening 30. The size of the opening 30 is such that the external sides of each hook 40 slide along the side of the opening 30 and elastically move inwards the pins 38. The linear movement continues until the hooks pass through the opening 30 and the pins 38 return to their initial position.

Then, the pins 38 and the opening 30 create a snap-together connection locking the shield 6 to the mask 2.

To unlock the shield 6 from the mask 2, the user holds the shield by the grasping surfaces 26, 27 as described here above and pulls the shield to break apart the mask and the shield. As the hooks 40 form an obtuse angle with the respective pins and the pins have elasticity of flexure, the pins 38 bend inwards until the hooks 40 withdraw from the sides of the opening 30. The user is then free to take away the shield 6 from the mask 2.

The man skilled in the art understands that the choice of the obtuse angle and of the elasticity of flexure of the pins has an impact on the stability of the locking mechanism, particularly on the stability of the locking position and on the needed strength to unlock the shield.

The described locking mechanism has the advantage to put in place, or to take out, the shield by a natural movement of the user.

While the invention has been illustrated and described in details in the drawings and foregoing description, such illustration and description are to be considered illustrative or exemplary and not restrictive; the invention is not limited to the disclosed embodiment.

For instance, the guidance elements may have different forms such as, for instance, a two-teeth fork adapted to be inserted into two funnel-type holes.

The invention claimed is:

1. A head protective equipment comprising:

a breathing mask connectable to a breathing-gas source and adapted to be applied, in a use position, around a user's nose and mouth, for supplying said user with breathing gas;

an eye protective shield adapted to be applied around the user's eyes; and first and second lock elements, respectively, located on said mask and on said shield, and adapted to cooperate with each other in order to secure said shield to said mask when said mask is in said use position around said user's nose and mouth, said first and second elements being adapted to engage and interlock with each other to create a snap-together connection, said shield and said mask being adapted to be locked together by a two-step movement, the first step comprising approaching the shield to the mask until said shield reaches said mask, and the second step comprising a substantially linear movement of bringing said shield closer to said user's nose until locking, wherein said shield comprises a grasping unit around said second lock element, said grasping unit comprising two substantially vertical surfaces and one substantially horizontal surface, said surfaces being adapted to receive said user's fingers during the positioning of said shield onto said mask, and the second lock element comprises two flexible pins, each flexible pin having a proximal end and a distal end, being oriented substantially parallel to said substantially linear movement, being attached to the grasping unit by their proximal ends and having at their distal ends a hook, each hook being turned outwards with respect to the other flexible pin, and the first lock element comprises a plane having an opening passing through the plane, wherein in locking position, both of the flexible pins extend through the opening and create a snap fit with respect to the opening, and said hooks press along sides of said opening, wherein pulling of the grasping unit in a direction opposed to the mask bends the flexible pins inward toward one another such that the hooks withdraw from the sides of the opening, and wherein the snap fit is maintained solely by an elasticity of flexure of the flexible pins.

2. The head protective equipment according to claim 1, wherein said vertical surfaces are adapted to receive the user's thumb and middle finger and said horizontal surface is adapted to receive the user's forefinger.

3. The head protective equipment according to claim 1, wherein said opening has a substantially rectangular shape and said hooks press along the small sides of said rectangular opening.

4. The head protective equipment according to claim 1, wherein said hooks have a substantially triangular shape such that, during the locking movement, in a first step, each pin is pushed inwards by a pressure of the side of said opening on an external side of each hook until, in a second step, each hook is positioned beneath said opening and each pin returns substantially to its initial position by a resilient movement to lock said mask and said shield together.

5. The head protective equipment according to claim 1, wherein said hooks form an obtuse angle with the respective pins, and said pins have elasticity of flexure such that, when the user draws the shield from the mask, the pins bend inwards and the hooks pass through the opening to unlock the shield from the mask.

6. The head protective equipment according to claim 1, wherein said mask comprises guidance elements to guide said shield to the locking position during the second-step of substantially linear movement.

7. The head protective equipment according to claim 6, wherein guidance elements comprise a support area adapted to receive said shield at the end of the first step movement.

8. The head protective equipment according to claim 6, wherein said mask has guidance surfaces, diverging from a ridge situated substantially in coincidence with said user's nose bridge, and forming two wings that are substantially symmetrical with respect to a median plane of symmetry of said user's face when the equipment is being worn by said user, said wings being substantially parallel to said substantially linear movement.

9. The head protective equipment according to claim 8, wherein said grasping unit comprises two convex parts adapted to slide along said guidance surfaces.

10. The head protective equipment according to claim 1, wherein said mask comprises a harness fitted with straps adapted to maintain said mask in said use position on the user's head and said mask comprises two positioning members of said harness adapted to position said harness outside the area of the user's face covered by said shield when said shield is in said use position.

11. The head protective equipment according to claim 10, wherein guidance elements comprise a support area adapted to receive said shield at the end of the first step movement and said support area comprises said positioning members.

12. The head protective equipment according to claim 1, wherein each flexible pin comprises an inward-facing surface and an outward facing surface and an inwardly inclined portion in which the flexible pins come closer to one another toward the distal end.

13. The head protective equipment according to claim 12, wherein the grasping unit comprises first and second contacting pins, the first contacting pin contacting the outward facing surface of the inwardly inclined portion of one of the flexible pins and the second contacting pin contacting the outward facing surface of the inwardly inclined portion of the other flexible pin.

14. The head protective equipment according to claim 13, wherein the contacting pins bend the flexible pins inward toward one another at the distal end when the grasping unit is pulled in a direction opposed to the mask.

15. The head protective equipment according to claim 12, wherein each inwardly inclined portion is distant from the proximal end of the flexible pin.

16. The head protective equipment according to claim 12, wherein the contacting pins extend substantially perpendicularly to the flexible pins.

17. The head protective equipment according to claim 1, wherein the grasping unit contacts the flexible pins to bend them inward.

* * * * *